US006889826B2

(12) United States Patent
Harada et al.

(10) Patent No.: US 6,889,826 B2
(45) Date of Patent: May 10, 2005

(54) LUMINOUS CONTAINER

(75) Inventors: Shiro Harada, Koga (JP); Masahiko Fujita, Koga (JP); Toshifumi Shinohara, Koga (JP)

(73) Assignee: Lumica Corporation, Koga (JP)

( * ) Notice: Subject to any disclaimer, the term of this patent is extended or adjusted under 35 U.S.C. 154(b) by 234 days.

(21) Appl. No.: 10/277,987

(22) Filed: Oct. 23, 2002

(65) Prior Publication Data

US 2003/0147234 A1 Aug. 7, 2003

(30) Foreign Application Priority Data

Feb. 4, 2002 (JP) ..... 2002-026702

(51) Int. Cl.[7] ..... F21K 2/06
(52) U.S. Cl. ..... 206/219; 362/34
(58) Field of Search ..... 206/219, 222, 206/459.5, 459.1; 362/34

(56) References Cited

U.S. PATENT DOCUMENTS 5,552,968 A * 9/1996 Ladyjensky ..... 362/34
6,062,380 A * 5/2000 Dorney ..... 206/217
6,474,467 B1 * 11/2002 Kurdian ..... 206/222

* cited by examiner

*Primary Examiner*—Jacob K. Ackun, Jr.
(74) *Attorney, Agent, or Firm*—Westerman, Hattori, Daniels & Adrian, LLP

(57) ABSTRACT

The present invention provides a container including a housing with an opening and a wall. The wall includes an inner case 2 fitting into an outer case 1 while leaving a given distance therebetween to form first and second chambers. The first chamber 3 is located around the periphery of the opening of the housing. Further, a capsule 4 is housed in the first chamber 3. First and second substances capable of chemiluminescence upon reaction with one another are contained in the capsule 4 and in the second chamber 6, respectively.

31 Claims, 10 Drawing Sheets

LUMINOUS CONTAINER

FIELD OF THE INVENTION

The present invention relates to a luminous container usable for various articles such as a cup, candy box or vase.

BACKGROUND OF THE INVENTION

Some luminous cups have heretofore been known. For instance, one conventional luminous cup comprises a housing, a capsule placed in a space between the inner and outer bottom walls of the housing, and two different liquid agents filled, respectively, in the space and in the capsule. The liquid agents are capable of chemiluminescence upon reaction with one another. When the capsule is broken by a user, the liquid agents are mixed together to cause chemiluminescence, and the generated light projects out through the outer wall. By virtue of the light, the user can easily handle the cup, even at night, and enjoy the illumination and other effects. In another conventional luminous cup, a plurality of the capsules is arranged vertically in a space between the inner and outer sidewalls of the housing. However, the capsules of the conventional cups have been formed in straight shapes. This causes the following disadvantages in addition to the restriction on the location of the capsule chamber for receiving the capsules therein.

Firstly, in the cup having the capsules placed in the bottom portion of the housing, the small space of the bottom portion sets a limit on the number of the capsules, and thereby the capsules cannot have a large diameter. As a result, the limited volume of the liquid agent in the capsules makes it difficult to achieve an optimum ratio of the two liquid agents for chemiluminescence. Further, since the capsules are housed in the bottom portions, it is more difficult to break the capsules by external force or manual operation. If the capsules are successfully broken, the agents in the capsules are not adequately mixed with the other agents because the other agents are in the side portions of the housings.

Secondly, in a cup having the capsules vertically in the side portion of the housing, the capsule chamber creates a protrusion extending outward or inward in the side portion. This deteriorates the aesthetic configuration of the cup. The increased thickness of the side portion makes it difficult to stack the plurality of cups by fitting one within another, resulting in increased storage space requirements and degraded portability. Further, in order to obtain the chemiluminescence, it is necessary to bend the side portion of the housing repeatedly due to the number of the capsules. The liquid agents in the capsules are distributed unevenly around the capsule chambers arranged vertically. This provides strong lights only in certain portions and the entire cup cannot give off light evenly.

SUMMARY OF THE INVENTION

In view of the above problems in the conventional containers, it is an object of the present invention to provide an improved luminous container capable of achieving various intrinsic effects of chemiluminescence while keeping a desirable configuration.

It is another object of the present invention to provide an improved luminous container capable of desirably arranging a capsule containing an agent for chemiluminescence.

In order to achieve these objects, according the present invention, there is provided a container comprising a housing having an opening and a wall which defines the opening, and a storage space contiguous with the opening. The wall includes inner and outer wall segments arranged to form therebetween a pair of first and second chambers in communication with one another. The first chamber extends approximately in parallel with at least a part of the periphery of the opening. A breakable capsule is housed in the first chamber, and a first substance is contained in the capsule. A second substance is contained in at least the second chamber. The second substance is capable of chemiluminescence upon reaction with the first substance. At least a part of the outer wall segment is optically transparent, allowing chemiluminescence caused in the chambers to be seen from outside of the housing.

At least a part of the housing may have flexibility, allowing manual deformation thereof for the capsule to be broken. Preferably, both of the inner and outer wall segments are made of a plastic material having flexibility and optical transparency. In view of the substances for chemiluminescence, an optimal material of the housing is polyethylene or polypropylene. It is not essential to provide optical transparency to the inner wall segment. When the inner wall segment is made of an opaque material, a desirable color of the material may be white. In this case, the chemiluminescence is reflected by the white inner wall segment and directed outside to provide enhanced brightness.

The first and second substances for chemiluminescence may be chemical agents in liquid form. One of the first and second substances may be a fluorescent material, such as a material including oxalate and dibutyl phthalate, and the other is an oxidizing agent, such as a material including of hydrogen peroxide, catalyst, dimethyl phthalate and t-buthanol. However, the materials are not limited to the above components. A suitable ratio of fluorescent material to oxidizing agent is in the range of 5:1 to 1:1.

For example, in order to obtain the chemiluminescence all over the wall of the housing, the fluorescent material and oxidizing agent may be contained in the second chamber and in the capsule, respectively, because the second chamber generally has a larger volume. Alternatively, a plurality of pairs of first and second chambers may be provided with hermetic isolation from each other. In this case, it is necessary to consider cost, performance, and the change of the configuration of the housing due to the increased number of the capsules and the first chambers.

The material of the capsule may include plastic or glass. Particularly, the capsule made of glass can be broken into small pieces to facilitate release of the substance contained therein.

The first chamber for receiving the capsule therein is disposed approximately in parallel with at least part of the periphery of the opening of the housing. Preferably, the capsule has a shape in conformity with the shape of the periphery of the opening, for example, a ring or circular shape, semicircular shape, or L-shape (FIGS. 8, 9 and 10). The shape of the capsule is not limited to the above shape, and any other suitable shape, other than a straight shape, can be used to provide a desirable curvature or bend in conformity with the shape of the periphery of the opening of the housing. A suitable thickness of the glass capsule is in the range of 0.1 mm to 0.5 mm. For example, a circular glass capsule (see FIG. 8) can be prepared by forming a straight glass tube into a spiral tube, cutting the spiral tube into a plurality of circular tubes, fusedly closing one of the open ends of the circular tube, filling the substance in the circular tube, and fusedly closing the other open end of the tube. Alternatively, a semicircular glass capsule (see FIG. 9) can be prepared by fusedly closing one of the open ends of a straight glass tube, heating the entire tube to 700 to 800 degrees centigrade, forming the heated tube into a semicircular shape, filling the substance in the semicircular tube, and fusedly closing the other open end of the tube.

When the circular first chamber is arranged around the periphery of the housing, the periphery having a diameter of about ϕ80 mm (see FIG. 2), the entire length of the capsule is about 250 mm. In the conventional cup using a straight capsule, it is necessary to provide three capsules each having a length of 80 mm, and such straight capsules cannot be arranged in conformity with the periphery of the opening but housed only in the side portion of the housing away from the opening. Further, if a number of the straight capsules are arranged to satisfy the requirement of the ratio of the fluorescent material and oxidizing agent, it needs to repeatedly push the side portions of the housing in which the straight capsules are arranged, to obtain the chemiluminescence. On the other hand, in the present invention, the first chamber for receiving the capsule therein can be compactly arranged around and adjacent to periphery of the opening of the housing. Thus, the capsule can be readily broken by deforming the opening.

Thus, the configuration of the housing is preferably formed in a cylindrical shape, however, it is not limited to the cylindrical shape. In order to provide a simplified structure, the housing may comprise a cup-shaped outer case and a cup-shaped inner case fitted into the outer case, thereby forming the first and second chambers therein. While the inner and outer cups must have a clearance therebetween, or they must provide a space for the chambers, particularly for the second chamber, it is difficult to adequately maintain the space due to the flexibility of the housing. Further, when gas is generated in connection with the chemiluminescence, the housing may expand and be deformed, and thereby the level of the mixed substance for the chemiluminescence is lowered or an empty space develops at the upper portion of the housing, resulting in a reduced area of luminescence. While this problem can be solved by increasing the thickness of the housing or using a material having higher stiffness, such measures have limitations because the housing preferably has flexibility for manually causing deformation thereof, allowing the capsule to be broken so as to mix the fluorescent material with the oxidizing agent.

In view of this point, the outer surface of the inner wall segment may be partially associated with the inner surface of the outer wall segment to provide a contact portion or an integral portion therebetween.

The integral portion may be provided by partially bonding the respective bottom portions and/or the side portions of the inner and outer wall segments by means of ultrasonic bonding or the like to prevent the aforementioned deformation of the housing.

The contact portion effectively provides a given clearance between the inner and outer walls so as to maintain the volume of the chambers, particularly the second chamber. Further, the contact potion may be used to form the plural pairs of the first and second chambers. In this case, the first and second substances in each of the plural pairs of first and second chambers may be arranged to react with one another to exhibit a different color of chemiluminescence.

Further, by taking advantage of the first chamber capablity of being compactly arranged around the periphery of the opening of the housing, the wall may have a configuration allowing two of the containers identical to each other to be fitted with one inside the other by inserting the outer wall segment of one of the containers into the opening and storage space of the other container. This reduces storage space requirements and enhances portability of the containers.

It is to be understood that the container of the present invention may be used in combination with any other container, such as a container having an optically transparent and multicut or polyhedral housing.

Other features and advantages of the present invention will be apparent from the accompanying drawings and from the detailed description.

DESCRIPTION OF THE PREFERRED EMBODIMENTS

Various embodiments of the present invention will now be described with reference to the drawings.

Figure 1:
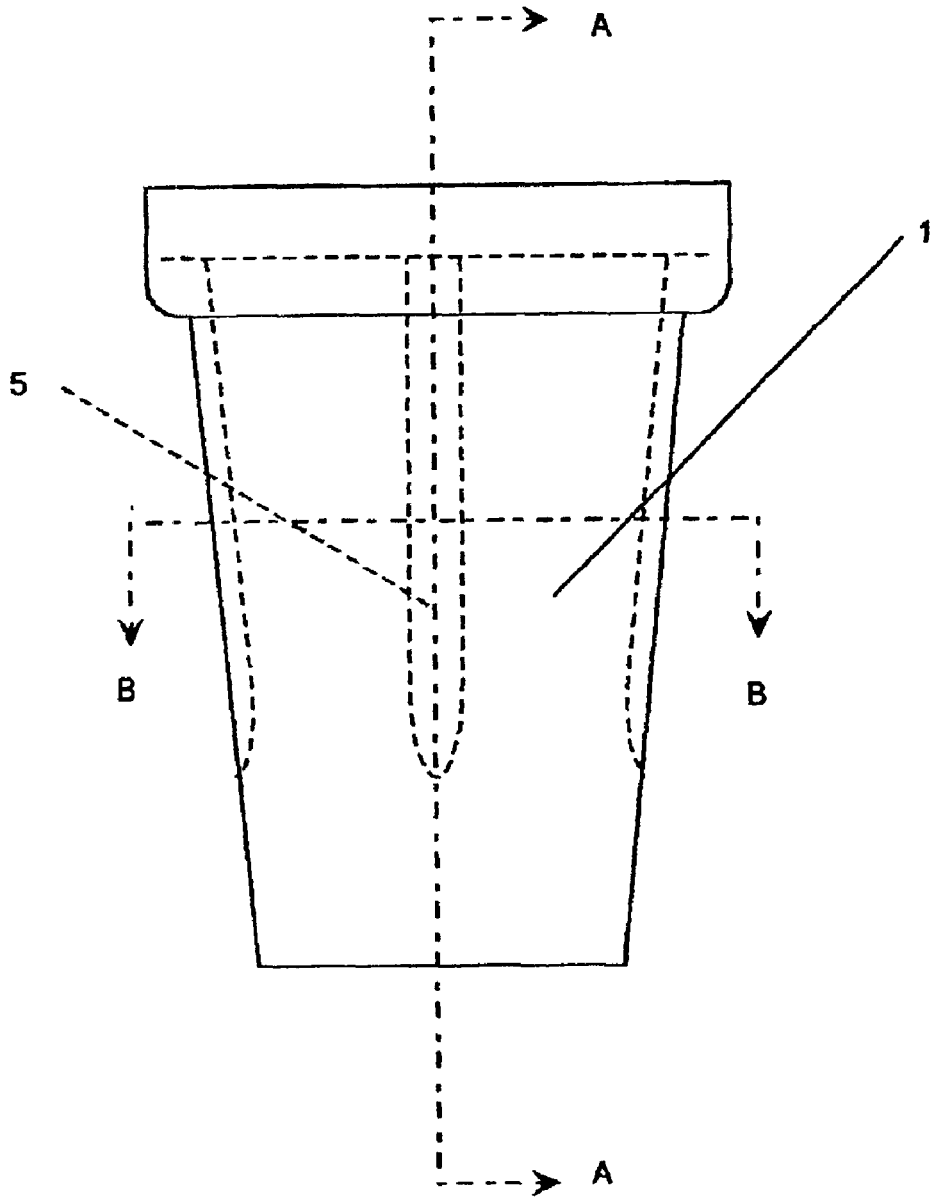
FIG. 1 is a front view of a cup according to a first embodiment of the present invention.
Figure 2:
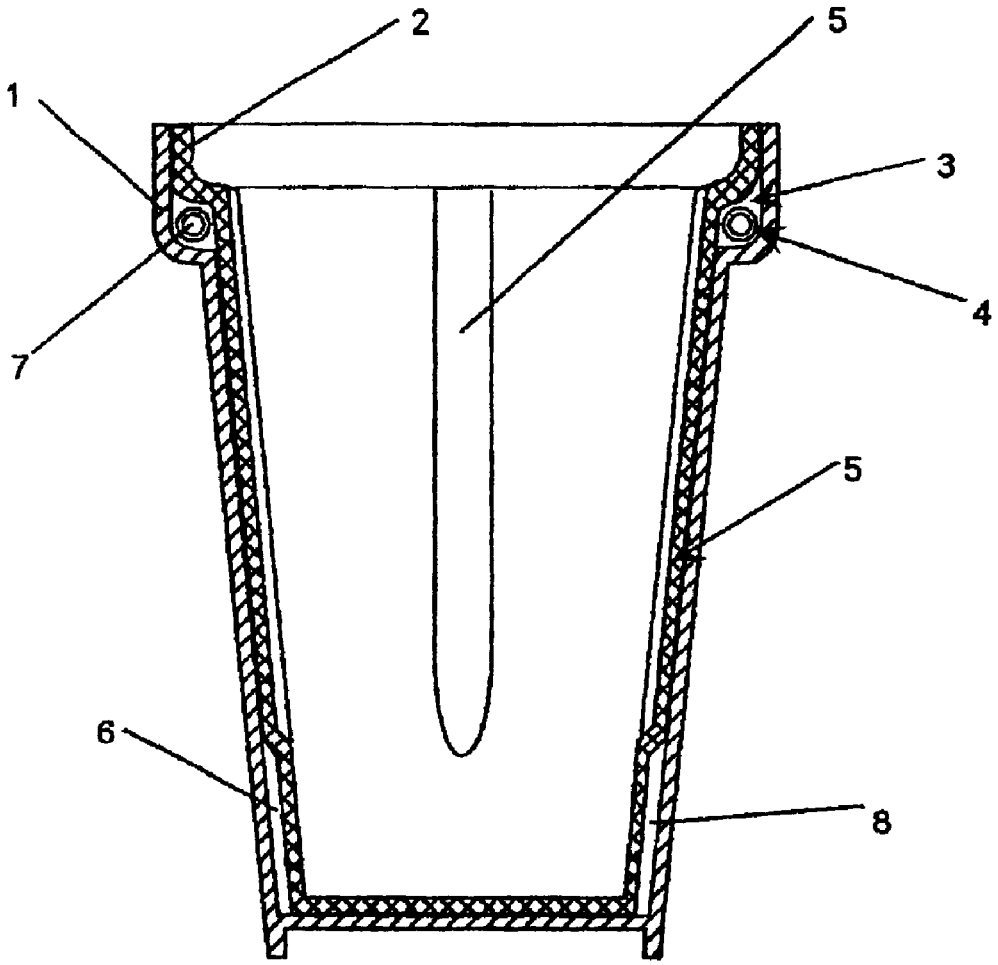
FIG. 2 is a sectional view taken along the line A—A of FIG. 1.
Figure 3:
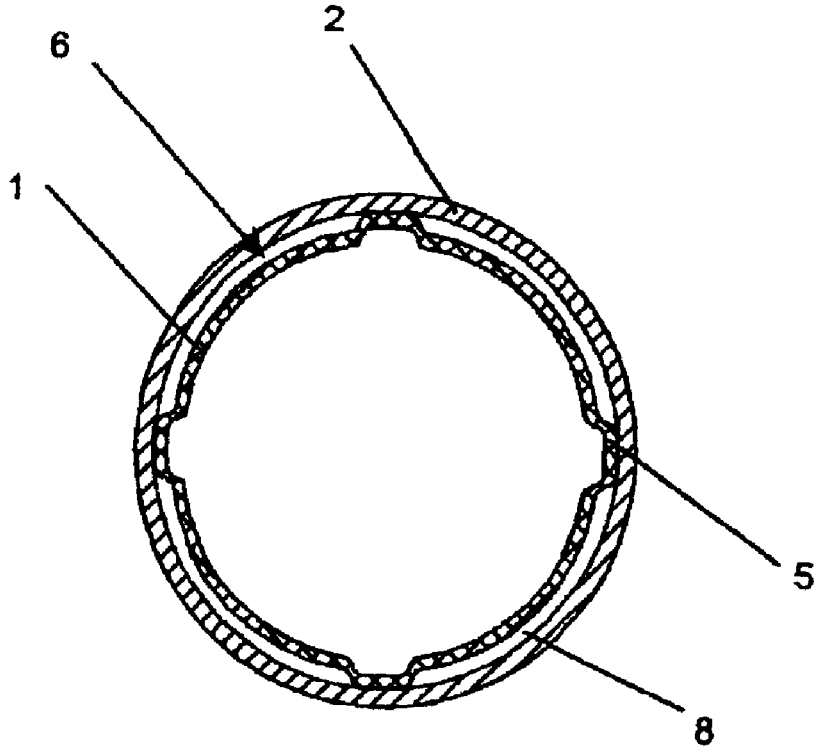
FIG. 3 is a sectional view taken along the line B—B of FIG. 1.

FIGS. 1 to 3 show a cup as a container according to a first embodiment of the present invention. The cup comprises a housing including an opening, and a wall defining the opening and a storage space contiguous with the opening. The wall includes a cup-shaped outer case 1 as an outer wall segment. As best shown in FIG. 2, the outer case 1 has a relatively larger opening of 80 mm in diameter, and includes a vertical flange portion surrounding the opening and having a height of 18 mm.

The wall further includes an inner case 2, having a shape similar to the outer case, as an inner wall segment. The inner case 2 has a vertical flange portion surrounding its opening as the opening of the housing. The vertical flange has a height of 10 mm, less than that of the flange portion of the outer case, to provide a first doughnut-shaped chamber 3 in parallel with or around the periphery of the opening of the inner case 2 when the inner case 2 is fitted into the outer case 1. The outer case 1 has an opening edge to be brought in contact with the opening edge of the inner case 2. The outer and inner cases 1 and 2 also have respective bottom portions to be brought in contact with one anther. The inner and outer cases are made of polypropylene having flexibility and optical transparency.

The outer surface of the inner case 2 has four vertically extending raised portions 5, each having a height of 1 mm at given intervals in the circumferential direction of the inner case. Each of the raised portions provides contact portions to be brought into contact with the inner surface of the outer case when the inner case 2 is fitted into the outer case 1.

Prior to fitting the inner case into the outer case, a pair of semicircular glass capsules 4 each having an outer diameter of ϕ5 mm are placed on the inner surface of the outer case defining the first chamber 3 to surround the opening of the housing. These glass capsules contain a total volume 2.4 cc of oxidizing agent in liquid form. Then, 8 cc of fluorescent material in liquid form capable of chemiluminescence upon reaction with the oxidizing agent are put in the outer case 1.

The inner case 2 is then fitted into the outer case 1 while partially maintaining a clearance of 1 mm between the inner surface of the outer case and the outer surface of the inner case to provide four second chambers 6, 8 each in fluid communication with the first chamber 3. The clearance is maintained by the contact portions 5. During this insertion operation, the fluorescent material rises along the second chambers 6, 8 up to a position close to the first chamber 3.

After completion of the insertion operation, the respective opening edges of the inner and outer cases are fusedly integrated to seal the first and second chamber against outside air. Optionally, the contact portions may be bonded by means of ultrasonic bonding or the like to integrate the inner and outer cases so as to prevent deformation of the housing. The respective bottom portions of the inner and outer cases may also be partially bonded.

This cup has a storage space defined by the opening of 80 mm in diameter, the bottom of 50 mm in diameter, and the relatively smooth inner surface of the inner case, in conformity with the outer shape of the cup. Thus, another cup can be fitted into the storage space.

Just before or after pouring beer or another drink into the cup, the flange portion is elliptically deformed by hand. This causes deformation of the first chamber to break the glass capsules therein. Then, the oxidizing agent flows out of the capsules and reacts with the fluorescent material in the second chambers to provide chemiluminescence. The light generated is directed outside through the outer case.

Figure 4:
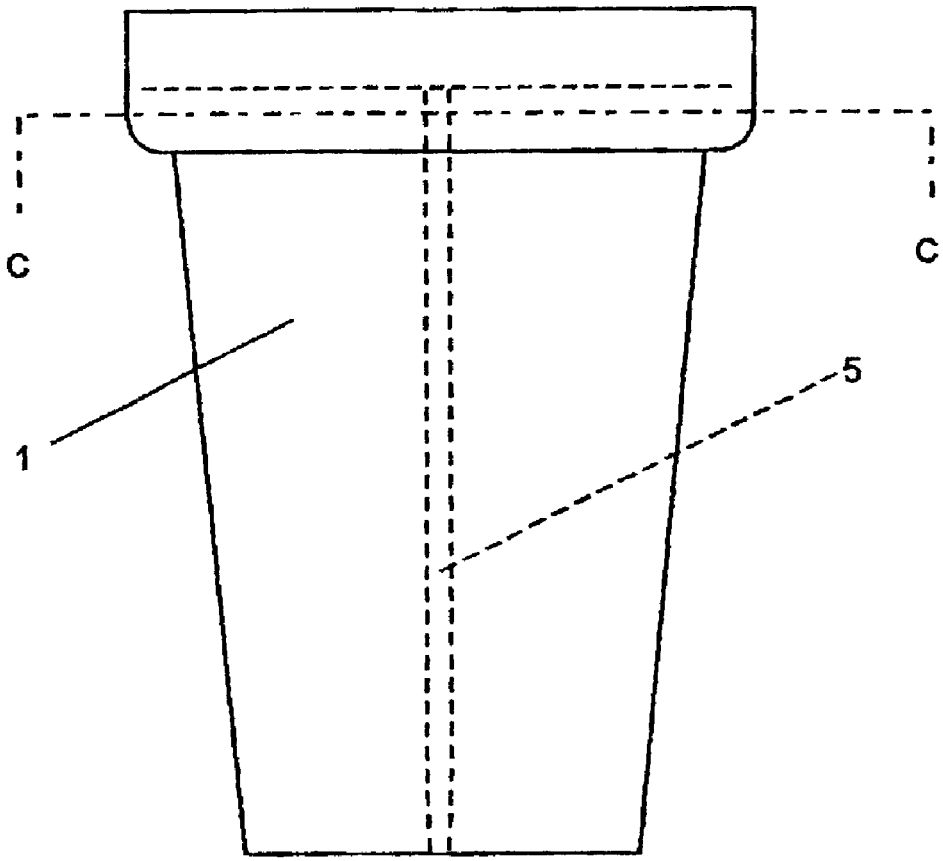
FIG. 4 is a front view of a cup according to a second embodiment of the present invention.
Figure 5:
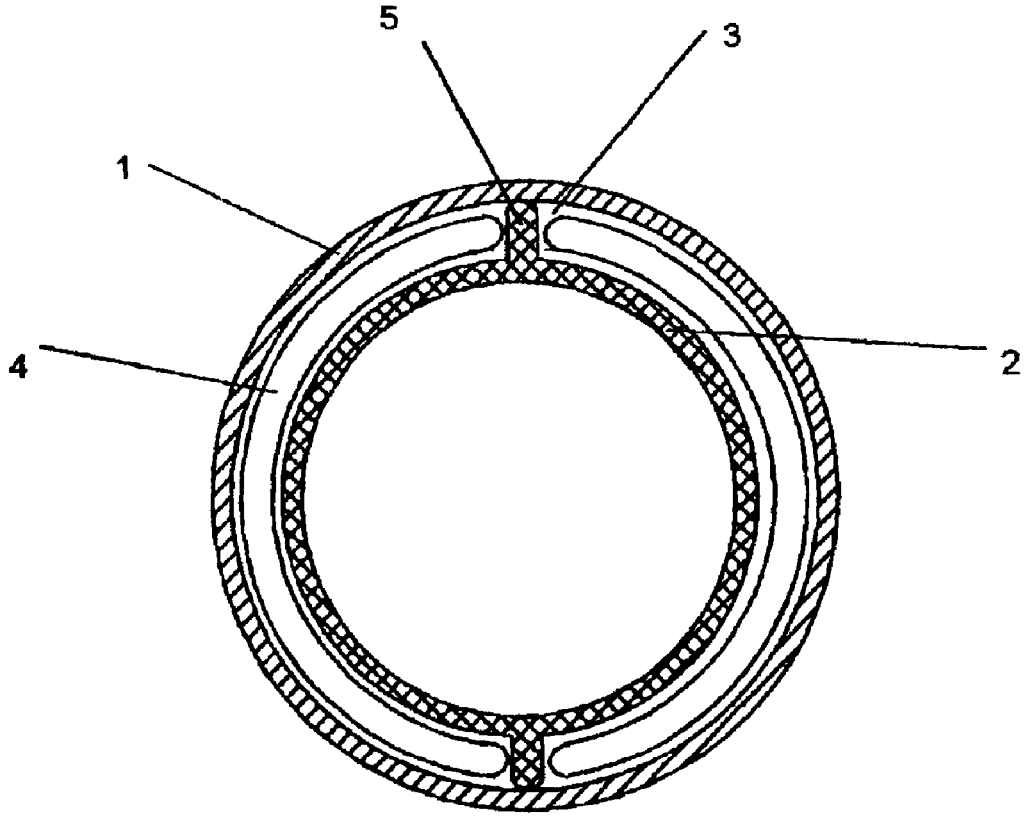
FIG. 5 is a sectional view taken along the line C—C of FIG. 4.

FIGS. 4 and 5 show a cup according to a second embodiment of the present invention. This cap has a structure similar to the cap of the first embodiment, excepting the raised portions 5. Thus, the same elements as those of the first embodiment are defined by the same reference numerals and their description will be omitted here. The cup 1 includes a pair of raised portions 5 extending vertically on the outer surface of the inner case 2 to separate a pair of first and second chambers 3 and 6 into two pairs by hermetic isolation from one another. Each of the separated first chambers 3 houses one semicircular capsule 4 containing an oxidizing agent, and each of the second chamber contains a fluorescent material. Each pair of the oxidizing agent and the fluorescent material are arranged as chemical components to react with one another to exhibit a different color of chemiluminescence. For example, one of the pairs of the oxidizing agent and the fluorescent material exhibits a blue color, and another pair exhibits an orange color.

Figure 6:
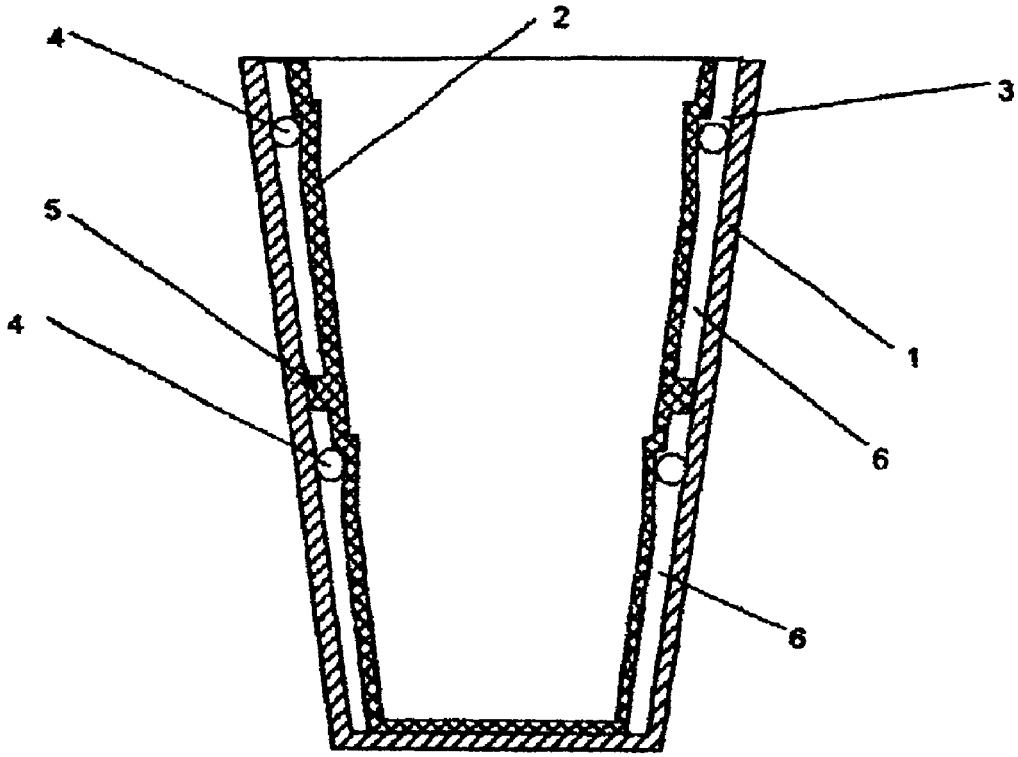
FIG. 6 is a sectional view of a cup according to a third embodiment of the present invention.

FIG. 6 shows a cup according to a third embodiment of the present invention. This cup includes a raised portion 5 extending in the circumferential direction of the outer surface of the inner case 2. The raised portion 5 is brought into contact with the inner surface of the outer case 1 to provide upper and lower second chambers 6 and 6 hermetically isolated from one another. An upper first chamber 3 and a first capsule 4 corresponding, respectively, to the first chamber 3 and the capsule 4 in the first embodiment, are provided in the upper second chamber 6. Further, in the lower second chamber 6, a lower first chamber 3 is provided by forming a concave portion in the outer surface of an inner case 2 to house a second capsule 4 containing an oxidizing agent. As with the second embodiment, by manually deforming the upper and lower first chambers 3 and 3 to break the first and second capsules 4 and 4, each pair of the oxidizing agent and the fluorescent material are selected to be reactable with one another to exhibit a different color of chemiluminescence in each of the upper and lower second chambers 6 and 6.

Figure 7:
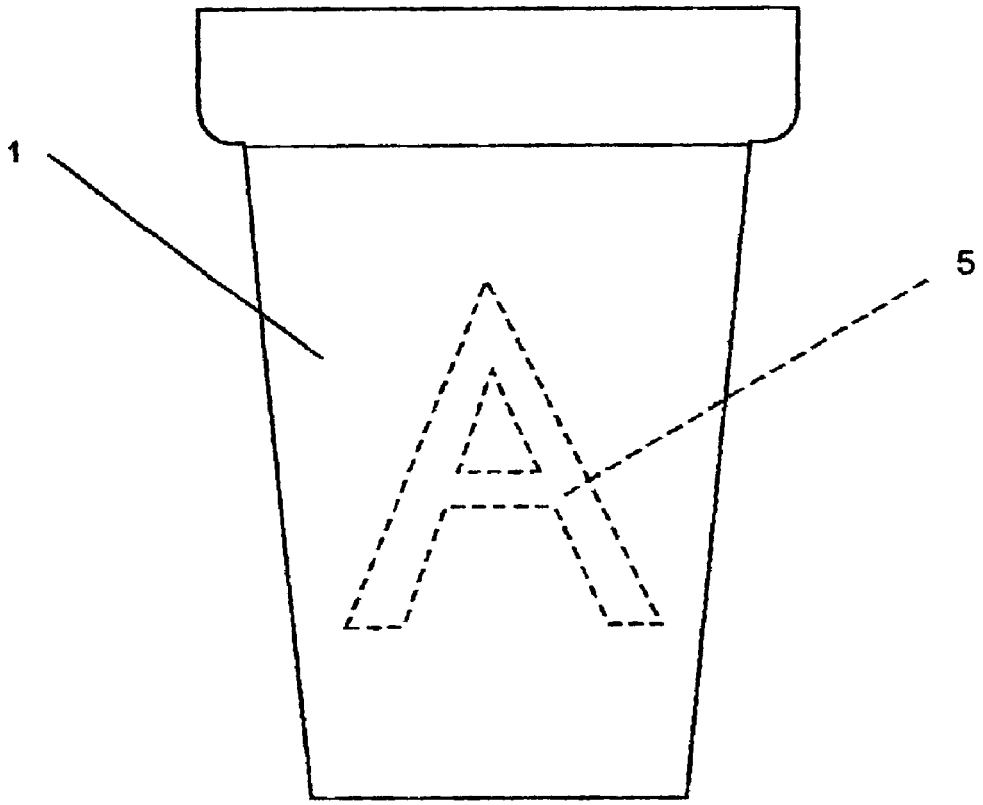
FIG. 7 is a front view of a cup according to a fourth embodiment of the present invention.
Figure 8:
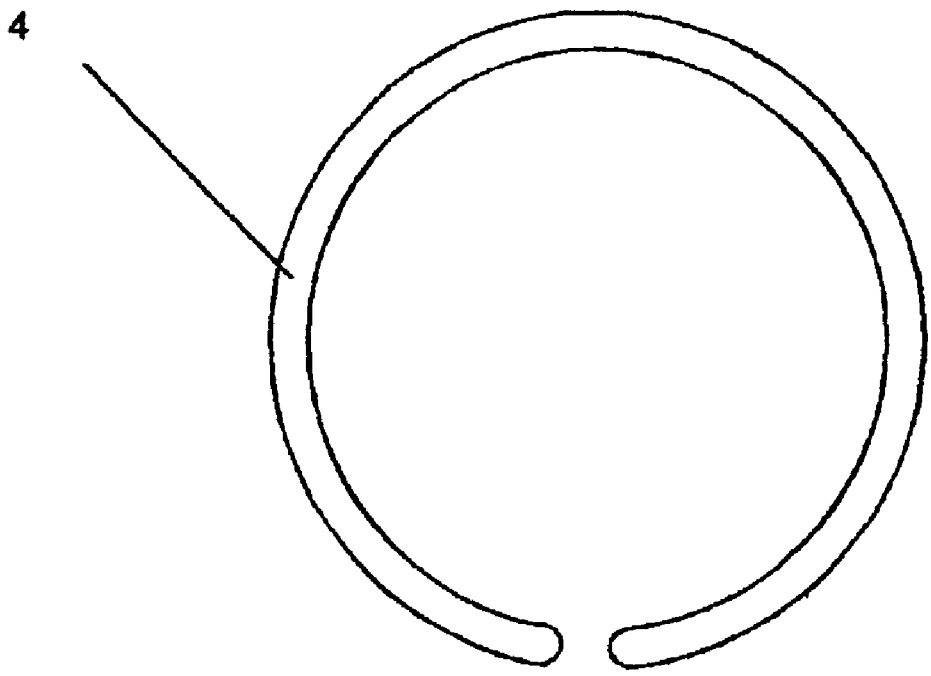
FIG. 8 is a top plan view of one example of a breakable capsule of the present invention.
Figure 9:
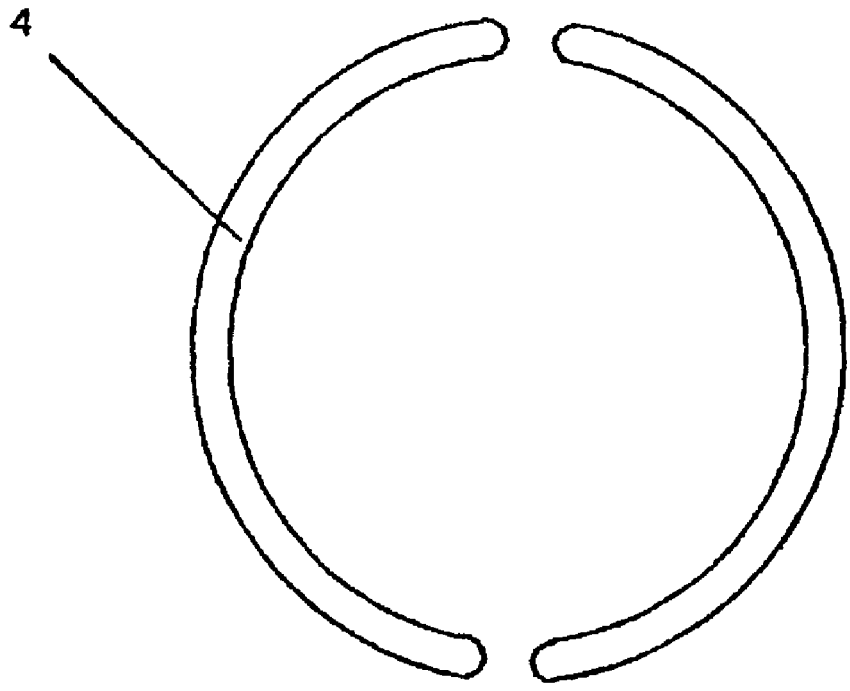
FIG. 9 is a top plan view of another example of the breakable capsule of the present invention.
Figure 10:
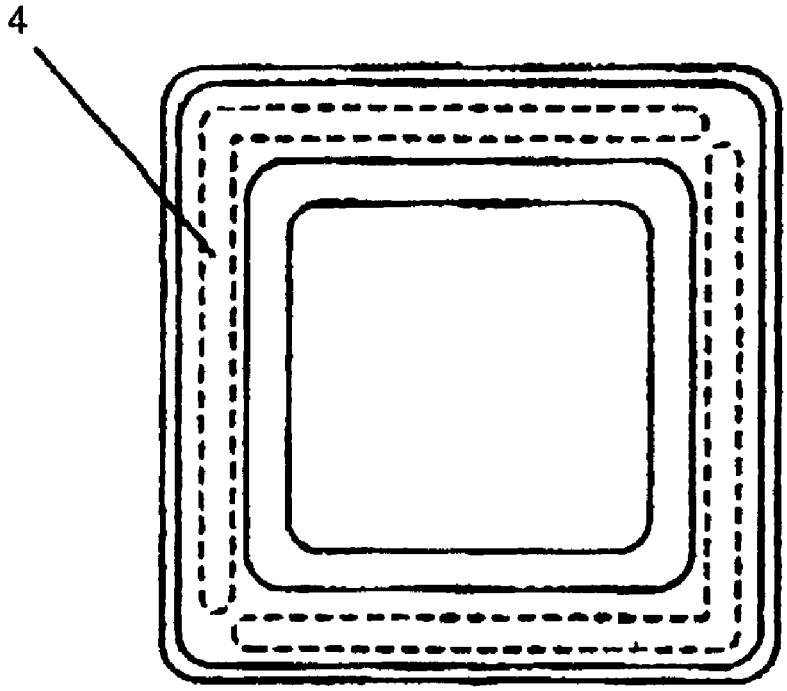
FIG. 10 is a top plan view of a cup with a rectangular cross section.

FIG. 7 shows a cup according to a fourth embodiment of the present invention. This cup has a structure similar to the cup according to the first embodiment, excepting the raised portions 5. In this cup, a raised portion 5 is formed on the outer surface of the inner case 1, and it is in close contact with the inner surface of the outer case 1 to define a contact portion having a character shape. The contact portion can prevent fluorescent material from entering therein. Thus, no chemiluminescence will be encased in the contact area, and the character can be displayed clearly. Alternatively, a patterned or lettered label may be attached on the outer surface of an outer case 1 or a given pattern or character may be printed on the outer surface of an outer case 1 to obtain the same effect.

As described above, according to the above embodiments, the first chamber for receiving the capsule therein can be compactly arranged around and adjacent to the periphery of the opening of the housing. Thus, the capsule can be readily broken by deforming the opening by hand to mix the first substance with the second substance.

Further, by faking advantage of the capsule capable of being arranged in conformity with the periphery of the opening of the housing, the housing can have a configuration allowing two of the cups identical to each other to fit one inside the other without any functional damage, and there can be provided evenly distributed chemiluminescence.

In addition, the capsule can formed in a ring or circular shape. In this case, the length of the capsule can be about three-times longer than the diameter of the opening of the housing, and thereby the ratio of fluorescent material and oxidizing agent can be optimally set. In particular, when the oxidizing agent is contained in the capsule, after breaking the capsule, the oxidizing agent can effectively generate chemiluminescence while gradually descending through the fluorescent material, because it has a specific gravity greater than that of the fluorescent material.

What is claimed is:

1. A container comprising:

an outer case;

an inner case fitted in said outer case to form an enclosed space therebetween, said enclosed space including a chamber extending along the outer periphery adjacent to an upper end of said inner case;

a ring-shaped or arc shaped breakable capsule housed in said chamber, said capsule containing a first liquid agent; and a second agent contained in said space, said second liquid agent capable of chemiluminescence upon reaction with said first agent.

2. A container as defined in claim 1, which includes a plural number of said chambers.

3. A container as defined in claim 1, wherein said capsule is formed in a shape selected from a group of a spiral shape, a ring shape and an arc shape, and one or more of said capsules are housed in said chamber.

4. A container as defined in claim 1, wherein an outer surface of said inner case is partially brought into contact with an inner surface of said outer case to provide a support portion for maintaining said space.

5. A container as defined in claim 4, wherein said support portion is formed in a given pattern or character shape.

6. A container as defined in claim 1, wherein an outer surface of said outer case has a patterned or lettered label attached thereon, or has a given pattern or character printed thereon.

7. A container as defined in claim 1, which further includes an additional case fitted into said inner case.

8. A container as defined in claim 4, wherein said support portion is formed to divide said space into plurality spaces, wherein said first and second agents in each of said divided spaces are capable of reacting with each other to exhibit a different color of chemiluminescence.

9. A container as defined in claim 1, wherein said outer case and inner cases are integrally connected with one another at a side or bottom wall thereof.

10. A container comprising:

a housing having an opening and a wall which defines said opening and a storage space continuous to said opening, said wall including inner and outer wall segments arranged to form therebetween a pair of first and second chambers in communication with one another, said first and second chambers extending along and adjacent to an outer periphery of said opening;

a ring-shaped or arc shaped breakable capsule housed in said first chamber, said capsule containing a first substance therein; and a second substance contained at least in said second chamber, said second substance capable of chemiluminescence upon reaction with said first substance, wherein at least a part of said outer wall segment has an optical transparency allowing chemiluminescence caused in said chambers to be seen from the outside of said housing.

11. A container as defined in claim 10, wherein at least a part of said housing has flexibility capable of manually causing a deformation thereof allowing said capsule to be broken.

12. A container as defined in claim 11, wherein said first chamber is disposed adjacent to said opening.

13. A container as defined in claim 12, wherein said wall includes a flange portion formed adjacent to said opening by said inner and outer wall segments, said flange portion having a diameter larger than the remaining portion of said wall away from said opening, wherein said first chamber is disposed in said flange portion.

14. A container as defined in claim 10, wherein said capsule has a shape in conformity with the shape of the periphery of said opening.

15. A container as defined in claim 10, wherein said capsule is formed in a shape selected from a group of a ring or circular shape, a semicircular shape and their combinations.

16. A container as defined in claim 10, wherein said first and second substances are chemical agents in liquid form.

17. A container as defined in claim 16, wherein one of said first and second substances is a fluorescent material, and the other is an oxidizing agent.

18. A container as defined in claim 16, wherein said first substance is an oxidizing agent and said second substances is a fluorescent material.

19. A container as defined in claim 10, wherein the outer surface of said inner wall segment is partially associated with the inner surface of said outer wall segment to provide a contact portion or an integral portion therebetween.

20. A container as defined in claim 10, which includes a plural pairs of said first and second chambers, hermetically isolated from each other, wherein each of said first chambers houses said capsule containing said first substance, and each of said second chambers contains said second substance.

21. A container as defined in claim 20, wherein the outer surface of said inner wall segment is partially associated with the inner surface of said outer wall segment to provide said plural pairs of said first and second chambers.

22. A container as defined in claim 20, wherein each pair of said first and second substances are reactable to exhibit a different color of chemiluminescence.

23. A container as defined in claim 19, wherein said contact or integral portion is formed in a given pattern or character shape.

24. A container as defined in claim 10, wherein said wall has a configuration allowing two of said containers to be fitted with one another by inserting said outer wall segment of one of said containers into said opening and storage space of the other container.

25. A container as defined in claim 10, wherein the outer surface of said outer wall segment has a patterned or lettered label attached thereon, or has a given pattern or character printed thereon.

26. A container comprising:

a housing having an opening and a wall defining said opening and an storage space continuous to said opening, said wall including inner and outer cases connected with each other to form therebetween a pair of first and second chambers in fluid communication with one another, said first and second chambers being disposed adjacent to said opening; and a ring-shaped or arc shaped breakable capsule housed in said first chamber, said capsule containing a first substance therein breakable capsule housed in said first chamber, said capsule containing a first liquid agent therein;

wherein a second liquid agent is contained at least in said second chamber, said second agent capable of chemiluminescence upon reaction with said first agent, wherein a part of said housing adjacent to said opening has flexibility capable of manually causing a deformation thereof allowing said capsule to be broken, and at least a part of said outer case has an optical transparency allowing chemiluminescence caused in said chambers to be seen from the outside of said housing.

27. A container as defined in claim 26, wherein the outer surface of said inner case is partially associated with the inner surface of said outer case to provide a contact portion or an integral portion therebetween.

28. A container as defined in claim 26, which includes a plural pairs of said first and second chambers, hermetically isolated from each other, wherein each of said first chambers houses said capsule containing said first liquid agent, and each of said second chambers contains said second liquid agent.

29. A container as defined in claim 26, wherein the outer surface of said inner wall segment is partially associated with the inner surface of said outer wall segment to provide said plural pairs of said first and second chambers.

30. A container as defined in claim 19, wherein each pair of said first and second liquid agents are reactable to exhibit a different color of chemiluminescence.

31. A container as defined in claim 20, wherein each pair of said first and second liquid agents are reactable to exhibit a different color of chemiluminescence.

* * * * *